US005318438A

United States Patent [19]

Sugahara et al.

[11] Patent Number: 5,318,438

[45] Date of Patent: Jun. 7, 1994

[54] BURNER LOW IN THE GENERATION OF NITROGEN OXIDES AND A SMALL COMBUSTION APPARATUS

[75] Inventors: Tatsuya Sugahara, Tokyo; Takao Takagi, Fuji; Kimio Mochizuki, Fujinomiya; Shigetoshi Akiyama, Fuji, all of Japan

[73] Assignees: Tokyo Gas Company Limited, Tokyo; Takagi Industries Co., Ltd., Shizuoka, both of Japan

[21] Appl. No.: 950,318

[22] Filed: Sep. 24, 1992

[30] Foreign Application Priority Data

Sep. 24, 1991 [JP] Japan ..... 3-272062
Apr. 19, 1992 [JP] Japan ..... 4-103326

[51] Int. Cl.[5] ..... F23Q 9/00

[52] U.S. Cl. ..... 431/285; 431/278; 431/328; 431/354; 126/92 R

[58] Field of Search ..... 431/285, 278, 328, 275, 431/12, 10, 346, 354; 126/92 R, 92 AC, 92 C, 85 R, 91 R

[56] References Cited

U.S. PATENT DOCUMENTS 5,062,788 11/1991 Best ..... 431/328
5,073,106 12/1991 Toyonaga et al. ..... 431/12

FOREIGN PATENT DOCUMENTS 110813 8/1980 Japan ..... 431/285

*Primary Examiner*—James C. Yeung
*Attorney, Agent, or Firm*—Townsend & Banta

[57] ABSTRACT

A small combustion apparatus for domestic or commercial use, wherein the quantity of combustion is increased by enhancing the mounting density of the burner units and to stabilize combustion using a lean fuel mixture resulting in a decreased generation of nitrogen oxides and noise. The burner has first and second burner units, arranged alternatively adjacently to one another. Each of the burner units has a flame port portion at the top of the burner body vertical and flat, has an inlet for fuel gas and air at the bottom of the burner body, has a mixing channel extending from the inlet to the flame port portion; and has inlets of the first burner units located below the inlets of the second burner units fuel gas spouts, are provided to correspond to the respective inlets of the first and second burner units.

19 Claims, 13 Drawing Sheets

BURNER LOW IN THE GENERATION OF NITROGEN OXIDES AND A SMALL COMBUSTION APPARATUS

BACKGROUND OF THE INVENTION

1. Field of the Invention

The present invention relates to a burner which is low in the generation of nitrogen oxides, used in a small combustion apparatus for domestic or commercial use.

2. Description of the Background

The nitrogen oxides ($NO_x$) in the exhaust gases from burners of various combustion apparatuses, are themselves toxic and are believed to cause acid rain and photochemical smog. So, for burners used in combustion apparatuses, various measures for decreasing the generation of $NO_x$ have been developed and utilized.

However, these measures are mainly taken for legally regulated, large combustion apparatuses for industrial use and other services, and it cannot be said that satisfactory measures are being taken for small combustion apparatuses for domestic or commercial use, especially with respect to the noise issue.

In the case of a large combustion apparatus, the large static pressure given by the combustion fan provides advantages such that the combustion gas and air can be easily controlled in flow. The burner is high in the degree of freedom of layout, and noise can be controlled easily. So, noise control is not difficult, and since the combustion chamber can be large, slow combustion as a means for decreasing $NO_x$ allows one to easily achieve perfect combustion. On the contrary, in the case of a small combustion apparatus, especially a small combustion apparatus for burning a large quantity, these advantages are not available and it is difficult to take measures for decreasing $NO_x$, as compared to large combustion apparatuses.

SUMMARY OF THE INVENTION

The objects of the present invention are to achieve a higher burner unit mounting density allowing a larger quantity of combustion and to achieve stable combustion using a lean fuel mixture to decrease nitrogen oxides and reduce noise.

Figure 1:
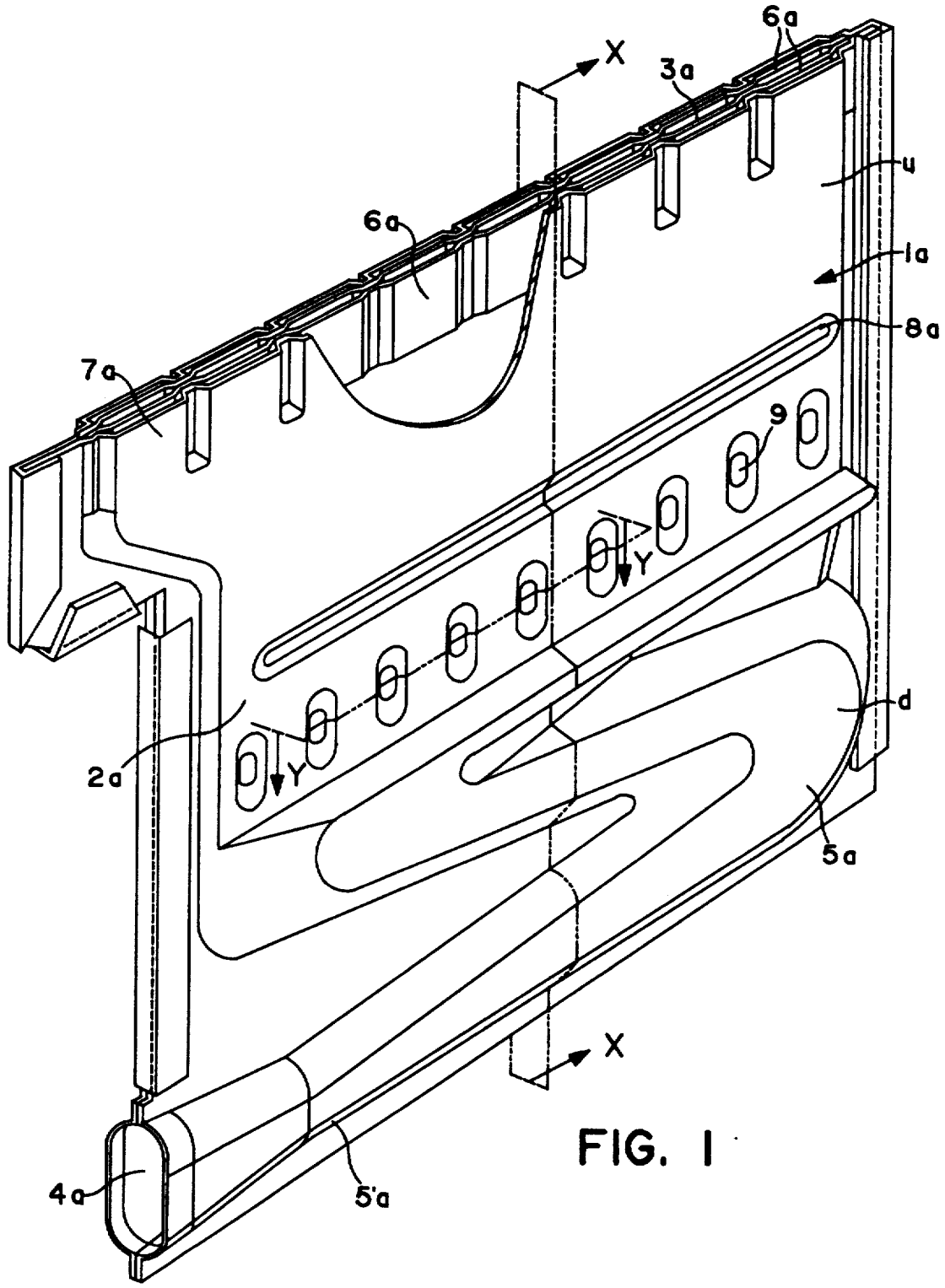
FIG. 1 is a perspective view showing the first burner unit comprising the burner of the present invention as an example.
Figure 2:
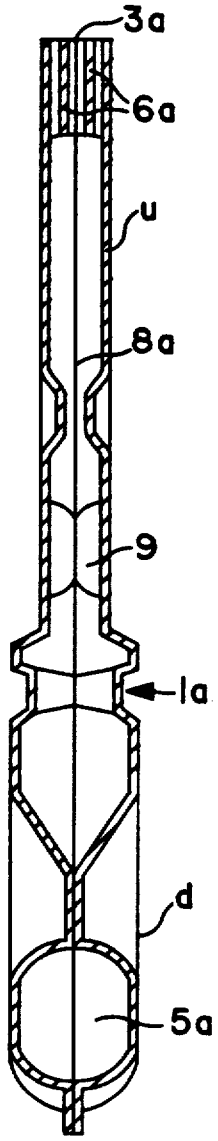
FIG. 2 is a section taken along the X—X line of FIG. 1.
Figure 3:
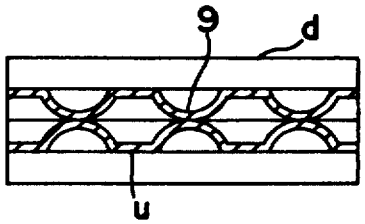
FIG. 3 is a section taken along the Y—Y line of FIG. 1.

1*a*—first burner unit
1*b*—second burner unit
2*a*, 2*b*—burner body
3*a*, 3*b*—flame port portion
4*a*, 4*b*—inlet
5*a*, 5*b*—mixer tube
5'*a*, 5'*b*—throat
6*a*, 6*b*—strip
7*a*, 7*b*—short-slit portion
8*a*, 8*t*—throttle portion
9—narrowing portion
10—flame retention plate
11—air chamber
12*a*, 12*b*—nozzle holder
13—housing
14—fan
15*a*, 15*b*—nozzle
16*a*, 16*b*—partition plate
17*l*, 17*r*, 17*m*—communicating pipe
18*l*, 18*r*, 18*m*—fuel gas supply pipe
19*a*—first flame
19*b*—second flame
20—air-fuel mixture ejection hole
21—electrode for flame detection
22—thick plate
23—electrode for ignition

DETAILED DESCRIPTION OF THE INVENTION

The means for solving the above problems are described below in reference to drawings showing embodiments.

The burner low in the generation of nitrogen oxides of the present invention comprises respectively plural first and second burner units, said units being arranged alternately adjacently to one another; each of the burner units, being composed of a flame port portion at the top of the burner body which is vertical and flat, and an inlet for fuel gas and air at the bottom of the burner body, and a mixing channel extending from the inlet to the flame port portion; the inlets of the first burner units; being located below the inlets of the second burner units; and fuel gas spouts, being provided to correspond to the respective inlets of the first and second burner units; wherein a lean fuel mixture is supplied to the first burner units, with the quantity of fuel gas kept larger than that supplied to the second burner units, and a rich fuel mixture is supplied to the second burner units.

In the above configuration, each of the burner bodies consists of a thin top section provided with a flame port portion at the top end and a thick bottom section provided with an inlet and a mixer tube, and each of the bottom sections of the second burner units is positioned between the top sections of the first burner units.

Additionally, according to the present invention, a burner low in the generation of nitrogen oxides, comprising respectively plural first and second burner units, said units being arranged alternately adjacently to one another; each of the burner units being composed of a flame port portion at the top of the burner body, and an inlet for combustion gas and air at the bottom of the burner body, and a mixing channel extending from the inlet to the flame port portion; fuel gas spouts, said spouts being provided to correspond to the respective inlets of the first and second burner units; and gas flow guide channels length not less than 5 times the equivalent diameter of the flame ports, which are provided at the flame port portions of the first burner units; wherein a lean fuel mixture is supplied to the first burner units, with the quantity of fuel gas kept larger than that supplied to the second burner units, and a rich fuel mixture is supplied to the second burner units.

In the burner low in the generation of nitrogen oxides as mentioned above, gas flow guide channels having a length not less than 5 times the equivalent diameter of the flame port, can be provided also at the flame port portions of the second burner units.

In the above burner, the gas flow guide channels can be formed by partitioning the channels to the flame ports by gas flow guide plates or by thick plates with flame ports perforated through them.

The inlets for fuel gas and air of the first burner units are located below the inlets of the second burner units, to present the inlets at two different stages, and the first and second burner units are arranged alternately and adjacently to one another. So, the burner units are arranged at a high density. In this case, if the top section with the flame port portion of each of the first burner units is made thinner than the bottom section with the inlet and the mixer tube of the first burner unit, and each of the lower sections of the second burner units is located between the adjacent top sections of the first burner units, then the burner units can be arranged at a high density.

Because of the above configuration, the distance from the inlet to the flame port portion in each of the first burner units is longer than that in each of the second burner units, and so the mixing of fuel gas and air is achieved well in the first burner units. Therefore, in the first burner units, a large quantity of air-fuel mixture with lean fuel uniformly mixed, can be supplied to the flame port portions.

In the above configuration, the lean fuel mixture is spouted for burning from the flame port portions of the first burner units, and the rich fuel mixture is spouted for burning from the flame port portions of the second burner units.

The combustion of the lean fuel mixture alone (i.e., air rich mixture alone) is poor in the stability of flames, but since stable flames using the rich fuel mixture exist adjacently to those flames, the stable flames act as pilot flames to stabilize the flames of the air rich mixture. Therefore, neither lift of flames nor oscillating combustion occurs to cause the generation of noise.

Since the combustion of the lean fuel mixture is stabilized by the flames of the rich fuel mixture (the combustion of air rich mixture), the temperature of the flames is kept low by the cooling action of the air rich mixture to generate less $NO_x$. Furthermore, since the quantity of the fuel gas presented for combustion as the lean fuel mixture is larger than the quantity of the fuel gas presented as the rich fuel mixture, the quantity of the $NO_x$ generated is small compared to the quantity of combustion by the entire burner.

The combustion noise greatly depends on the spouting condition of the air-fuel mixture from the flame ports of a burner, and if the spouting condition is turbulent, the combustion noise is large. However, in the present invention, gas flow guide channels having lengths not less than 5 times the equivalent diameter of the flame ports are provided to spout the air-fuel mixture in a sufficiently regular flow, combustion noise can be effectively reduced. Especially since the quantity of the air-fuel mixture spouted from the first burner units is larger than that from the second burner units, air rich mixture is burned. The noise reduction effect by the gas flow guide channels is achieved more than the first burner units. Therefore, even if the gas flow guide channels are provided only at the flame port portions of the first burner units, sufficient noise reduction effect can be achieved in the entire burner, but if the gas flow guide channels are provided also at the flame port portions of the second burner units, noise can be further reduced.

Embodiments of the present invention are described below in reference to the drawings.

Figure 4:
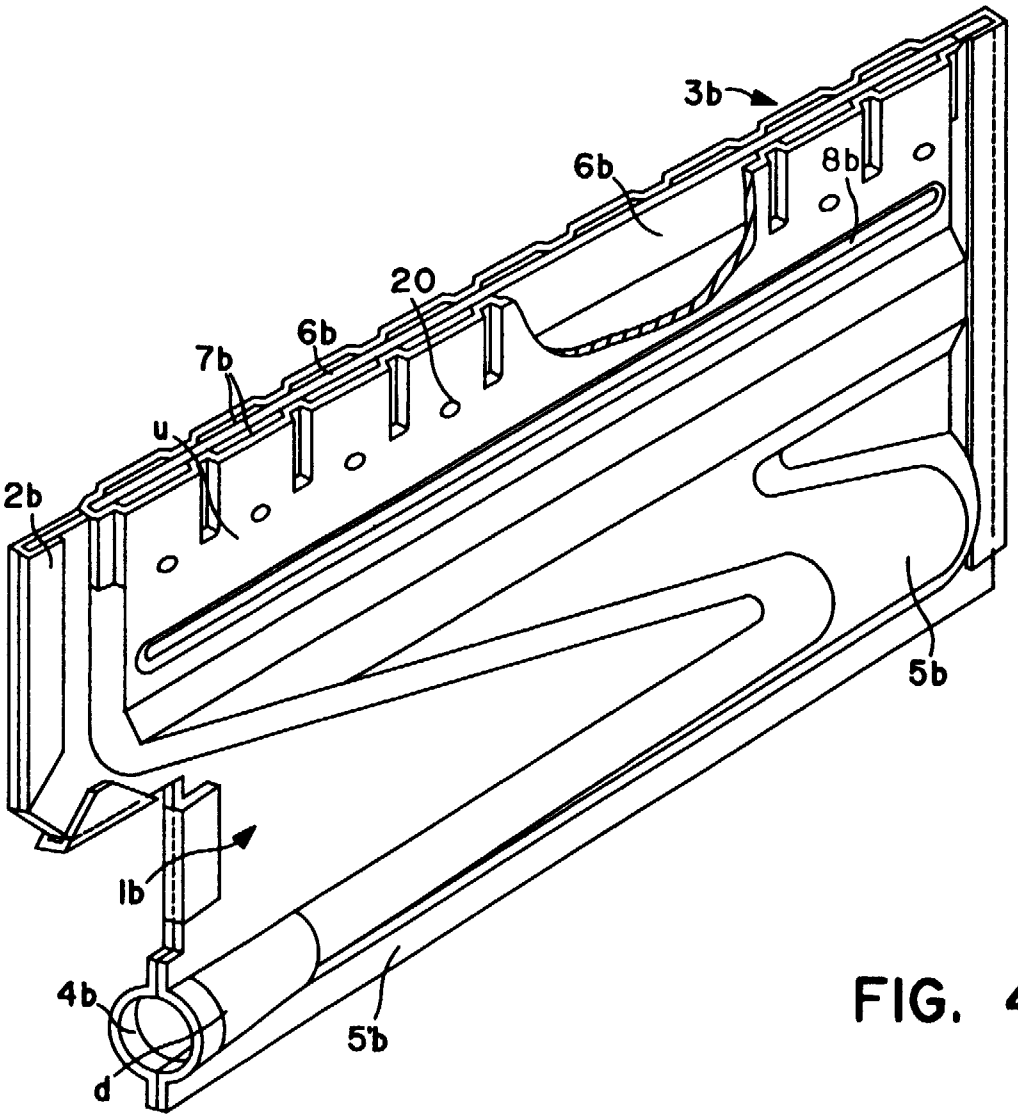
FIG. 4 is a perspective view showing the second burner unit comprising the burner of the present invention as an example.

FIGS. 1 and 4 are perspective views showing the first and second burner units 1*a* and 1*b* of the present invention respectively, as examples of embodiment. In each of the first and second burner units 1*a* and 1*b*, a flame port portion 3*a* or 3*b* is provided at the top of a vertical and flat burner body 2*a* or 2*b*, and an inlet 4*a* or 4*b* for fuel gas and air is provided at the bottom of the burner body, while a mixer tube 5*a* or 5*b* extends from the inlet 4*a* or 4*b* to the flame port portion 3*a* or 3*b*. In this case, the height of the burner body 2*a* of the first burner unit 1*a* is larger than that of the burner body 2*b* of the second burner unit 1*b*, and so the distance from the inlet 4*a* to the flame port portion 3*a* is longer than that of the second burner unit 1*b*.

Each of the burner bodies 2*a* and 2*b* of the first and second burner units 1*a* and 1*b* consists of a thin top section u with the flame port portion 3*a* and 3*b* at the top end and a thick bottom section d with the inlet 4*a* or 4*b* and the mixer tube 5*a* or 5*b*. The flame port portion 3*a* or 3*b* has plural short-slit openings arranged in one row formed by narrowing a long-slit opening at the top end of the top section u at predetermined intervals. As another structure, the flame port portion 3*a* or 3*b* can have many slits provided crosswise, or any other proper structure can be adopted.

According to one embodiment of the present invention, the flame port portion 3*a* or 3*b* can have many slits gap as gas flow guide plates, and the strips 6*a* are held in the top section u, to form nine short-slit portions 7*a*, each with three slits, at predetermined spacings in the longitudinal direction. On the other hand, the flame port portion 3*b* has one strip 6*b* as a gas flow plate in the top portion u of the burner body 2*b*, and the strip 6*b* is held in the top section u, to form nine short-slit portions 7*b*, each with two slits, at predetermined spacings in the longitudinal direction. In the respective flame port portions 3*a* and 3*b*, the vertical length of the strips 6*a* and 6b are not less than 5 times the equivalent diameter of the short-slit portions 7a and 7b. The strips 6a and 6b as gas flow guide plates, form gas flow guide channels at the flame port portions 3a and 3b. The equivalent diameter is defined, as is known, by 4S/L where S is the sectional area of a pipeline through which a fluid flows, and L is the perimeter. For the vertical length, h of the strips 6a and 6b, for the equivalent diameter, a concrete case is described later.

Each of the inlets 4a and 4b is formed as an opening of the bottom section d. Inside the opening, a throat 5'a or 5'b is formed. From the throat 5'a or 5'b, the mixer tube 5a or 5b extends to the other end of the bottom section d and returns from there to the bottom end of the top section u. The inlet 4a and the mixer tube 5a of the first burner unit la are larger in diameter than those of the second burner 1b, to allow introduction of more fuel gas and air.

Figure 7A:
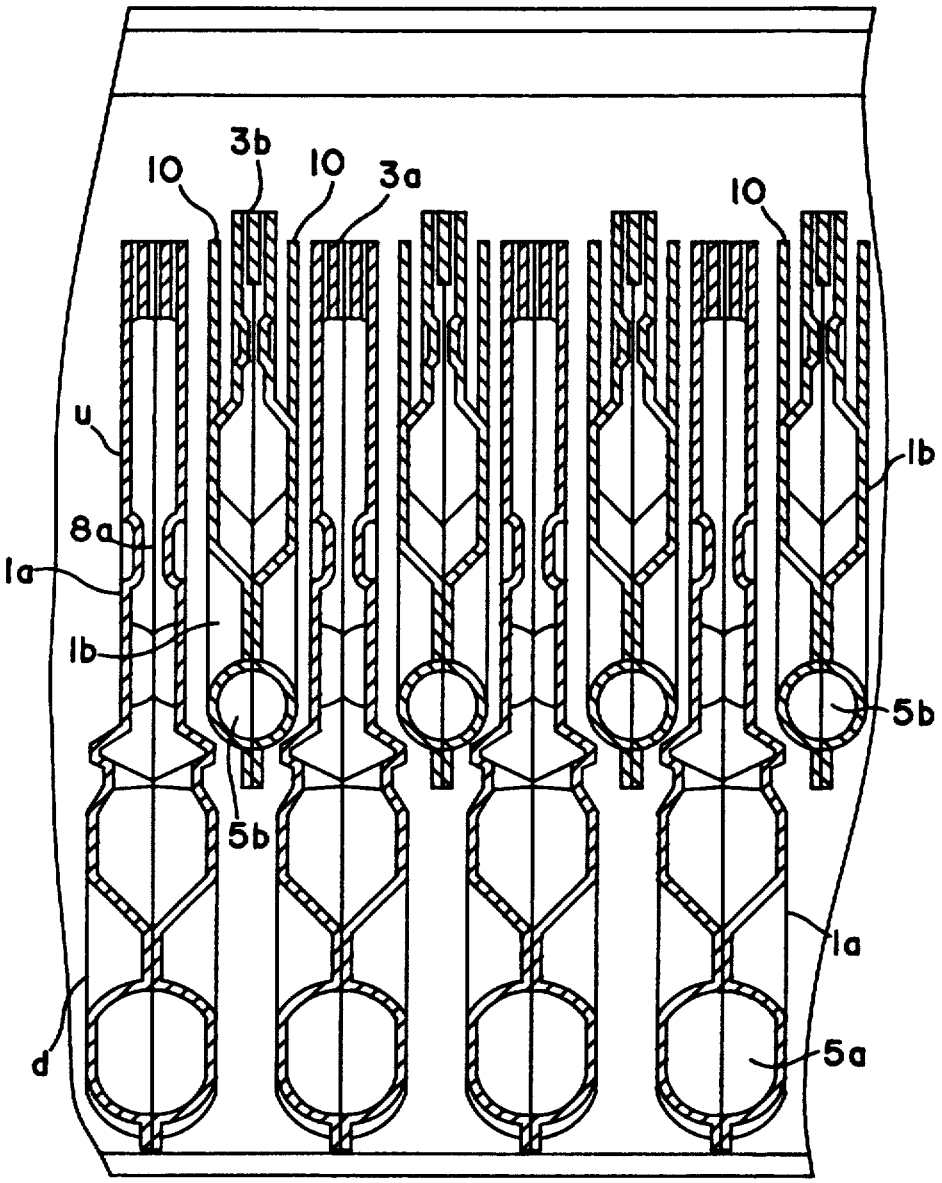
FIGS. 7A and FIG. 7B are an enlarged front view showing a portion of FIG. 6.
Figure 7B:
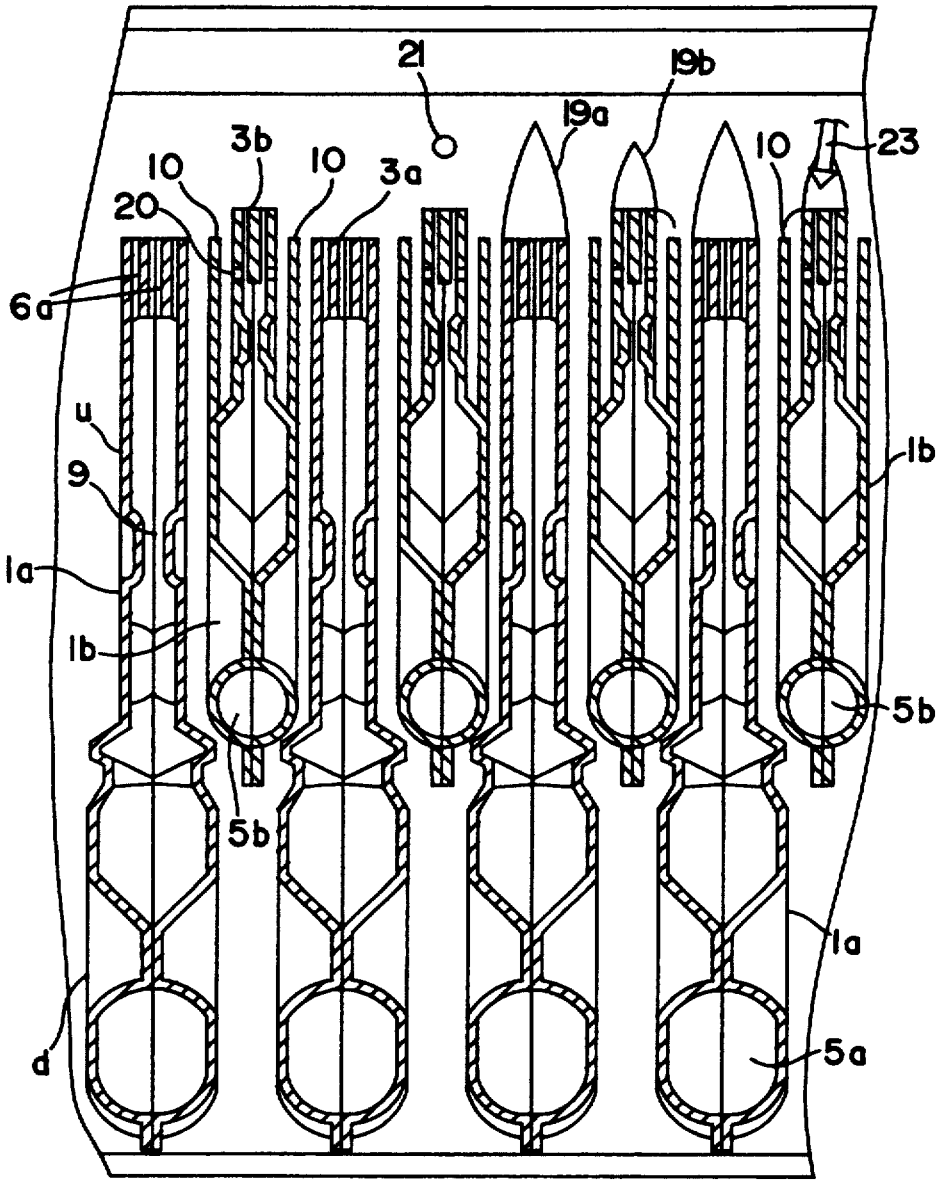

On the other hand, each of the first and second burner units 1a and 1b has a throttle portion 8a or 8b across the top section u, and the first burner unit 1'a is provided with narrowing portions 9 as gas flow guide portions at predetermined spacings upstream of the throttle portion 8a. Furthermore, outside the top section u of the second burner unit 1b, a flame retention plate 10 is provided as shown in FIG. 7A and FIG. 7B, and to correspond to the flame retention plate 10, the top section u is provided with an air-fuel mixture ejection hole 20 for flame retention. These components are optional.

Figure 5:
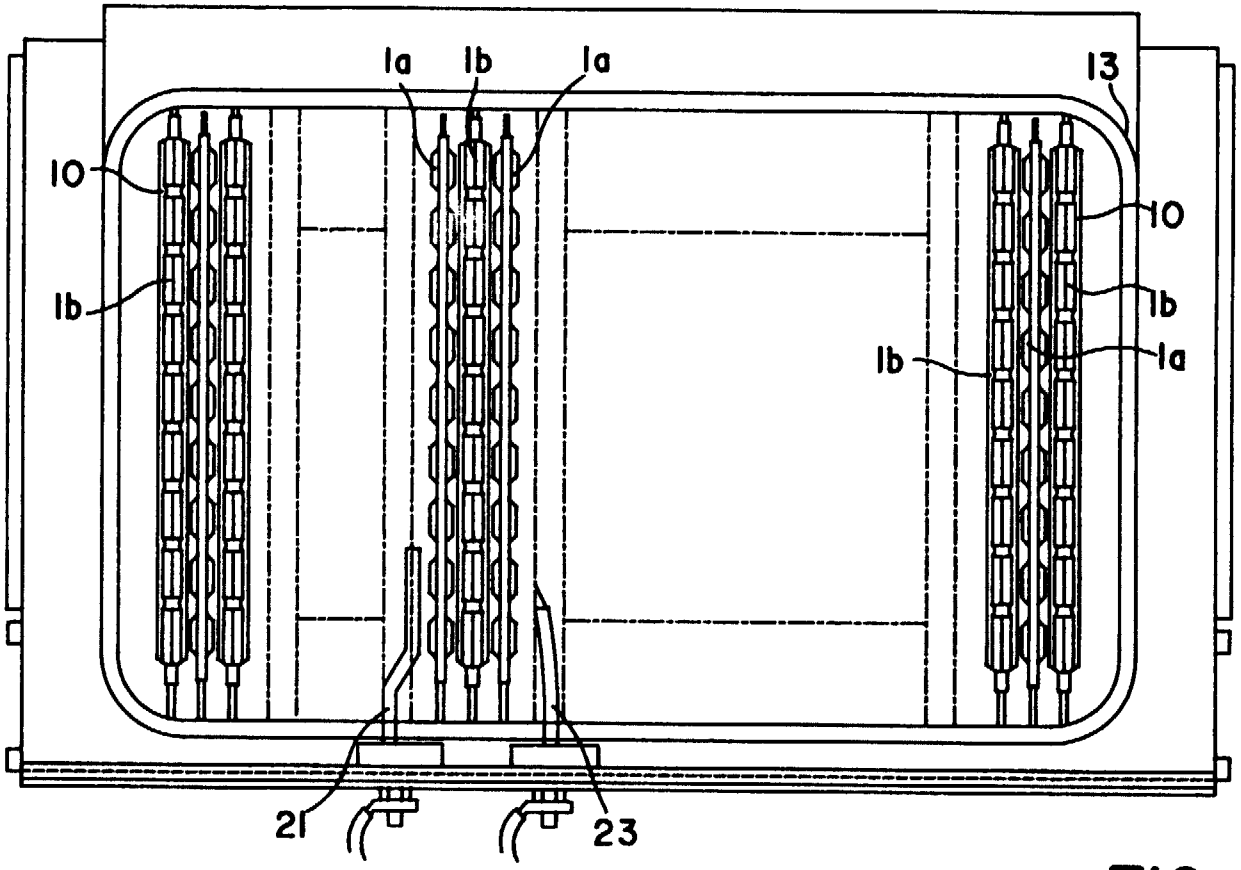
FIG. 5 is a plan view showing the construction of the burner of an embodiment of the present invention with some omission.
Figure 6:
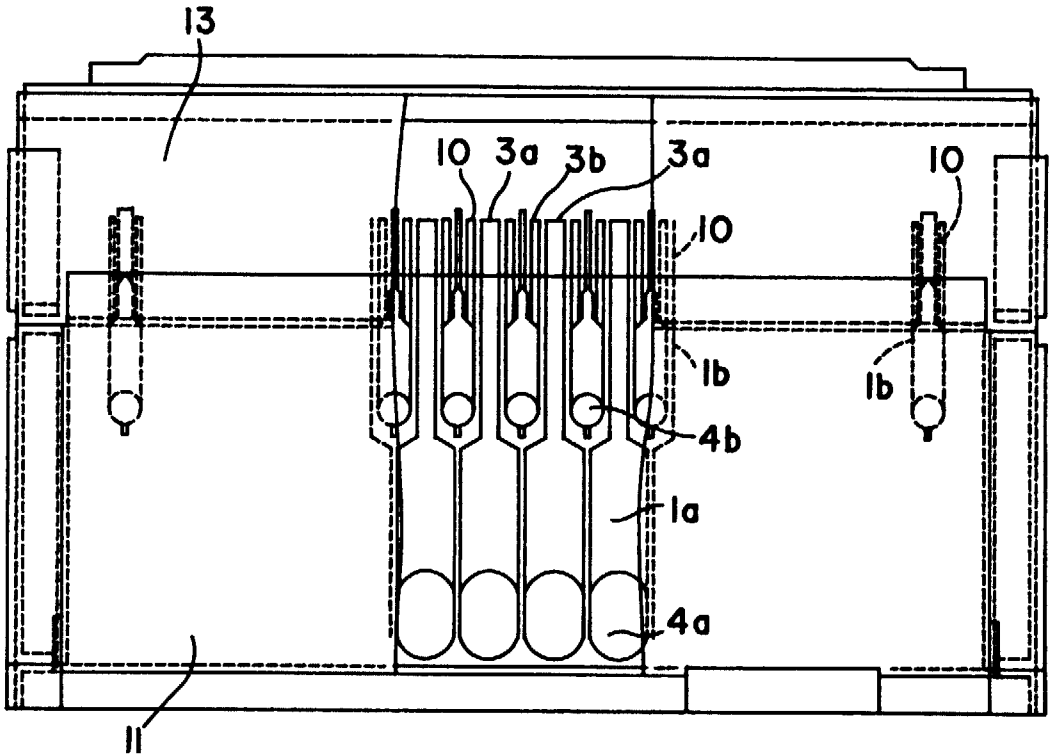
FIG. 6 is a partially cutaway front view showing the construction of the burner of the arrangement of the present invention.
Figure 8:
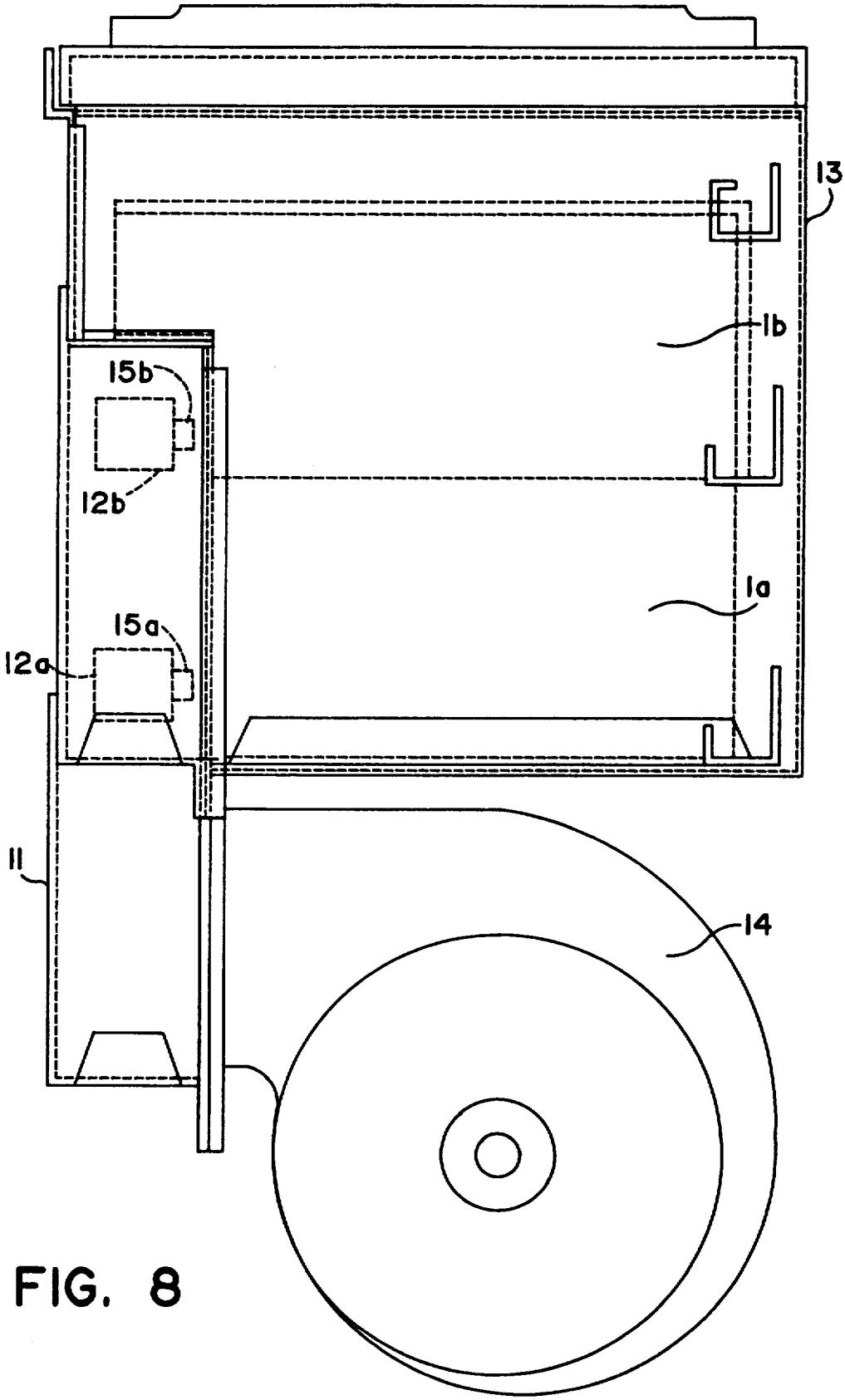
FIG. 8 is a side view showing the construction embodying the present invention.

FIGS. 5 to 8 show the entire structure of the burner composed of the first and second burner units 1a and 1b. FIG. 5 is a plan view showing the whole, but with some repeating parts omitted. FIG. 6 is a front view showing the whole where the air chamber 11 and first and second nozzle holders 12a and 12b described later are partially cut away. FIG. 7 is an expanded front view showing an essential portion of FIG. 6 and combustion state. FIG. 8 is its side view.

As shown in these drawings, many of the first and second burner units 1a and 1b are arranged alternately with their flame port portions 3a and 3b held with their tops at the same level or at some different levels, and supported in a housing 13. In one embodiment, as shown in FIGS. 6 and 7, the tops of the flame port portions 3a of the first burner units 1a are somewhat lower than those of the flame port portions 3b of the second burner units 1b, and are almost the same as the tops of the flame retention plates 10. As can be seen from FIGS. 5 and 6, at both ends of the burner unit 1a, one each of the second burner units 1b is located.

As described above, the height of the burner bodies 2a of the first burner units 1a are larger than the height of the burner bodies 2b of the second burner units 1b. So, as shown in FIGS. 6 to 8, the inlets 4a of the first burner units la are arranged in one horizontal row at a position below the inlets 4b of the second burner units 1b. Furthermore, the inlets 4b of the second burner units 1b are arranged in one horizontal row between the top section u of the burner bodies 2a of the first burner units 1a. Therefore, even though the inlets 4a and the mixer tubes 5a of the first burner units 1a are larger in bore, the adjacent top sections u of the first and second burner units 1a and 1b can be arranged at narrow spacings, and for this reason these first and second burner units 1a and 1b can be mounted at a high density.

The housing 13 has lower and upper nozzle holders 12a and 12b corresponding to the lower and upper rows of the inlets 4a and 4b of the first and second burner units 1a and 1b, that is, the lower first nozzle holder 12a corresponding to the first burner units 1a and the upper second nozzle holder 12b corresponding to the second burner units 1b are provided. These nozzle holders 12a and 12b are installed in an air chamber 11 opened in front, and fan 14 supplies air into the air chamber 11.

The first and second nozzle holders 12a and 12b respectively have fuel gas ejection nozzles 15a and 15b corresponding to the inlets 4a and 4b. The diameters and locations of the nozzles 15a and 15b and the diameters of the inlets 4a and 4b are set to satisfy the following conditions. The components corresponding to the first burner units 1a are set to satisfy the condition that a lean fuel mixture layer in quantity of fuel gas than that for the second burner units 1b may be supplied to the flame port portions 3a, and the above components corresponding to the second burner units 1b are set to satisfy the condition that a rich fuel mixture may be supplied to the flame port portion 3b. For example, the air ratio of the air-fuel mixture supplied to the flame port portions 3a of the first burner units 1a can be set at $\lambda \approx 1.2$ to 1.5 (where theoretical air ratio is $\lambda \approx 1$), and that of the second burner units 1b, at $\lambda \approx 0.4$. Furthermore, the ratio of the fuel gas quantities supplied to the respective flame port portions 3a and 3b can be set, for example, at a ratio of the first burner units 1a: the second burner units 1b = about 8:2 to 6:4. However, the respective air ratios and the ratio of fuel gas quantities can also be set properly beyond the respective ranges.

Figure 9:
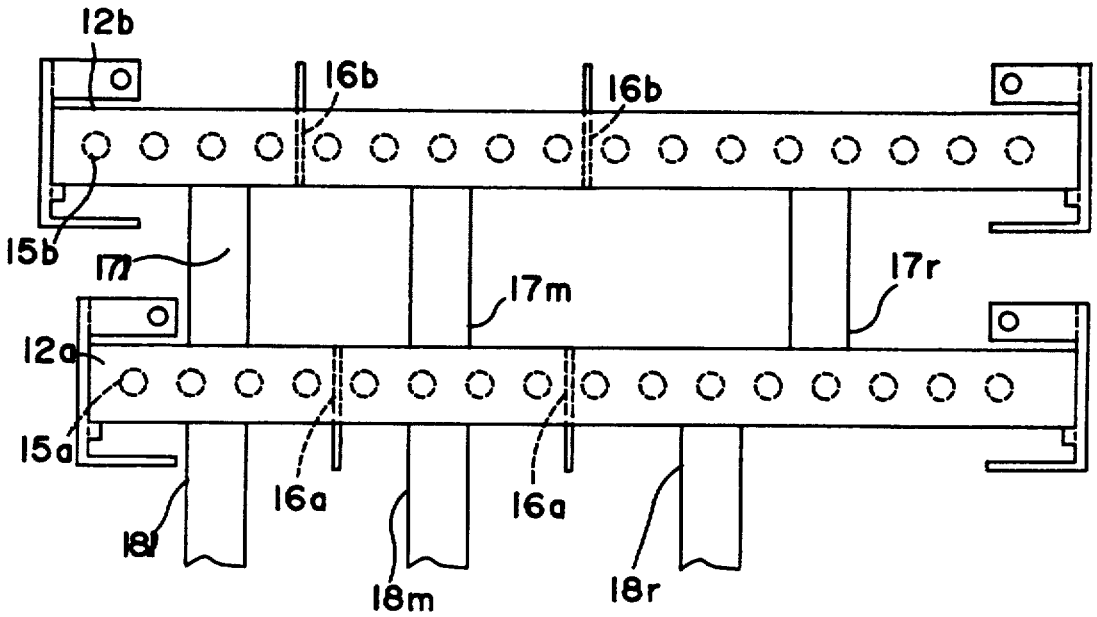
FIG. 9 is a front view showing the nozzle holders constituting the burner arrangement of the present invention, viewed from the side reverse to the nozzles.
Figure 10:
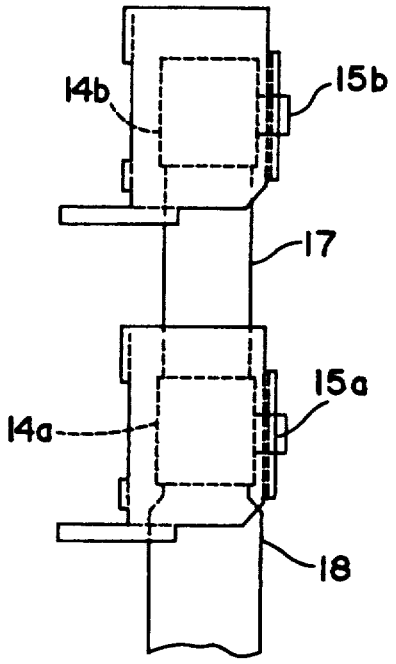
FIG. 10 is a side view showing the nozzle holders shown in FIG. 9.

FIG. 9 shows the portion concerning the nozzle holders viewed from the side opposite the nozzles, and FIG. 10 shows the portion viewed from a side. The first and second nozzle holders 12a and 12b are respectively divided into three portions of l, r and m by partition plates 16a and 16b, and those portions are respectively connected by communicating pipes 17l, 17r and 17m, and respectively provided with fuel gas supply pipes 18l, 18r and 18m.

As can be seen also from the arrangement of the nozzles 15a and 15b in these drawings, the burner of the present invention, with many burner units 1a and 1b alternately arranged, has one each of the second burner units 1b at both ends, as described before. In this case, the second burner units 1b corresponding to the nozzles 15b at both ends of the middle portion m of the second nozzle holder 12b, are arranged outside adjacently to the first burner units 1a corresponding to the nozzles 15a , at both ends of the middle portion m of the first nozzle holder 12a.

In the burner of the present invention as mentioned above, at first fuel gas is fed to all the fuel gas supply pipes 18l, 18r and 18m, and supplied to the first and second nozzle holders 12a and 12b through the communicating pipes 17l, 17r and 17m, and air is supplied from the fan 14 into the air chamber 11 for combustion.

The fuel gas supplied to the first and second nozzle holders 12a and 12b is spouted from the respective nozzles 15a and 15b toward the corresponding inlets 4a and 4b of the burner units 1a and 1b, and sucking the air around the fuel gas by the spouting energy, it is introduced into the burner bodies 2a and 2b. The fuel gas and air introduced into the burner bodies 2a and 2b from the inlets 4a and 4b in this way are mixed with each other while moving through the mixer tubes 5a and 5b to reach the respective flame port portions 3a and 3b, and from there they are spouted as air-fuel mixtures for combustion. In this case, as described before, from the flame port portions 3a of the first burner units 1a a lean fuel mixture is spouted, and from the flame port portions 3b of the second burner units 1b, a rich fuel mixture is spouted. Furthermore, the quantity of the fuel gas in the air-fuel mixture spouted from the flame port portions 3a of the first burner units 1a is larger than the quantity of the fuel gas in the air-fuel mixture spouted from the flame port portions 3b of the second burner units 1b.

By such supply of air-fuel mixtures, flames (first flames 19a) caused by the combustion of the lean fuel mixture, are formed above the flame port portions 3a of the first burner units 1a, and the flames (second flames 19b) caused by the combustion of the rich fuel mixture are formed above the flame port portions 3b of the second burner units 1b. In this case, since the second burner units 1b are located at both ends of the burner unit 1a, each of the first flames 19a has the second flames 19b on both sides.

The first flames 19a are caused by the combustion of the lean fuel mixture, and are unstable when they exist alone, but since the second flames 19b, located on both sides of each of the first flames 19a are caused by the combustion of the rich fuel mixture, the stable second flames 19b act as pilot flames to stabilize the first flames 19a. Therefore, lift of the first flames 19a and oscillating combustion are difficult to develop and thus inhibits the generation of noise.

The stability of the first flames 19a caused by the lean fuel mixture depends also on the mixing state of the air-fuel mixture, and is poor unless the air-fuel mixture is sufficiently uniformly mixed.

In this regard, in the burner of the present invention, as described before, since the distance from the inlets 4a to the flame port portions 3a of the first burner units 1a is longer than that of the second burner units 1b, the mixing distance is long enough to achieve good mixing of fuel gas and air, and even if the fuel is lean, a large quantity of a uniformly mixed air-fuel mixture can be supplied to the flame port portions 3a. Therefore, in the burner of the present invention, the stability of the first flames 19a is also good in this regard.

The combustion of the lean fuel mixture stabilized as described above, is due to the combustion of the air rich mixture, and its cooling action keeps the temperature of the flames 19a low, which decreases the generation of $NO_x$. Furthermore, since the quantity of the fuel gas used for combustion of the lean fuel mixture is larger than the quantity of the fuel gas used in the rich fuel mixture, the quantity of $NO_x$ generated is small compared to the quantity burned by the burner as a whole.

Then, in the above combustion state, if the supply of fuel gas from the fuel gas supply pipe 18r on the right-hand side in FIG. 9 is stopped, to stop the supply of fuel gas to the right-hand portion r of the first and second nozzle holder 12a and 12b, the flames at the first and second burner units 1a and 1b corresponding to the nozzles 15a and 15b in those portions are extinguished. As a result, only the first and second burner units 1a and 1b corresponding to the nozzles 15a and 15b in the middle portions m and the left-hand portions l of the nozzle holders 12a and 12b continue combustion.

The burner units located at both the extreme ends of the burner units 1a and 1b engaged in combustion are the second burner units 1b, and so as in the above mentioned combustion state, each of the first flames 19a has second flames 19b on both sides. Therefore, the action of the second flames 19b to stabilize the first flames 19a is not lost.

Subsequently, if the supply of fuel gas from the left combustion gas supply pipe 18l is also stopped in the above combustion state, only the first and second burner units 1a and 1b corresponding to the middle portions m of the first and second nozzle holders 12a and 12b continue combustion. Also in this combustion state, each of the first flames 19a has second flames 19b on both sides, and so the action of the second flames 19b to stabilize the first flames 19a is not lost.

In the embodiment described above, the flame port area to be used for combustion can be changed stepwise without disturbing the action of the second flames 19b to stabilize the first flames 19a, and therefore the quantity of combustion can be favorably adjusted in a wide range by utilizing any known combustion quantity control means such as proportional control.

Figure 11:
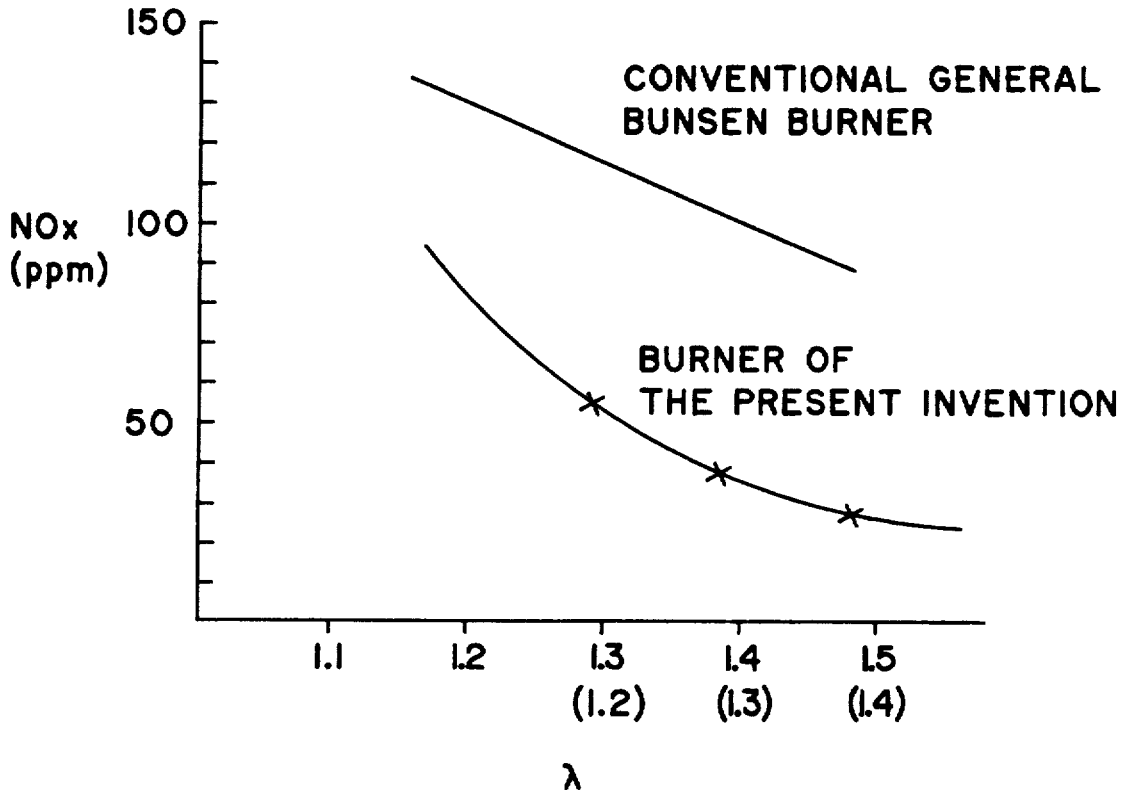
FIG. 11 is a diagram showing the quantities of $NO_x$ generated by the burner embodying the present invention, in comparison with the conventional Bunsen burner.

FIG. 11 shows the $NO_x$ emission characteristic of the burner of the present invention as an example. In this example using the illustrated burner, the diagram shows the relation between the air ratio of the burner as a whole chosen as the abscissa achieved by adjusting the air ratio of the lean fuel mixture in the first burner units 1a, and the quantity of $NO_x$ generated by such burning while the air ratio of the rich fuel mixture in the second burner units 1b is set at $\lambda \approx 0.4$ to 0.7. The indicated air ratio values include the cooling air which may be fed around the burner units 1a and 1b. The parenthesized air ratio values show the values without the cooling air. The ratio of the quantity of fuel gas burned in the first burner units 1a, to that in the second burner units 1b is 7:5:2:5.

From the diagram, it can be seen that the burner of the present invention is remarkably lower in the generation of $NO_x$ than the conventional general Bunsen burner.

Figure 12:
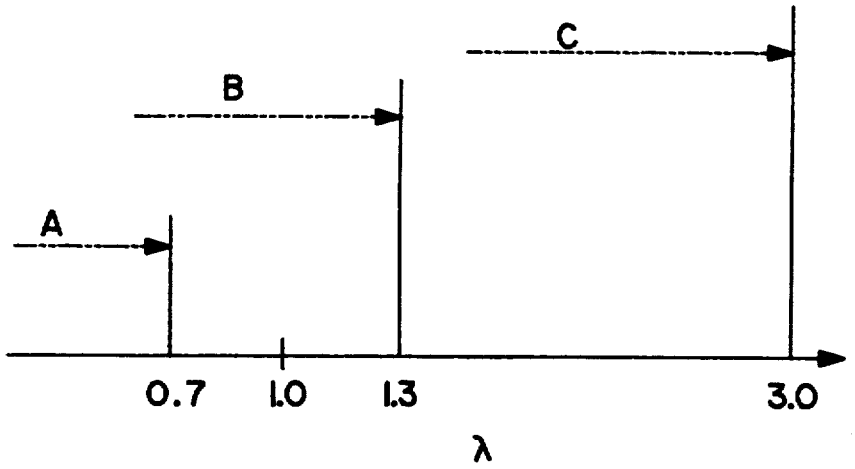
FIG. 12 is an illustration showing the lift limit of flames of the first burner units in the burner of the present invention as an example, in comparison with others.

FIG. 12 shows the lift limit of the first flames 19a by the first burner units 1a in the burner of the present invention, as an example in comparison with others.

Symbol A shows the lift limit of the first burner units 1a achieved when the lean fuel mixture is supplied to the first burner units 1a without the flame retention by the second flames of the second burner units 1b in the burner of the present invention, and the limit is $\lambda \approx$ about 0.7. On the contrary, symbol B shows the lift limit in the conventional general Bunsen burner with a flame retention mechanism, and the limit is $\lambda \approx 1.3$. Symbol C shows the lift limit of the first burner units 1a when both the first and second burner units 1a and 1b are used for combustion in the burner of the present invention and the limit is $\lambda \approx 3.0$.

From the above, it can be seen that the burner of the present invention allows stable combustion of highly rich air mixture compared to the conventional general Bunsen burner and can decrease the $NO_x$ generated by the combustion of highly rich air mixture.

Figure 13:
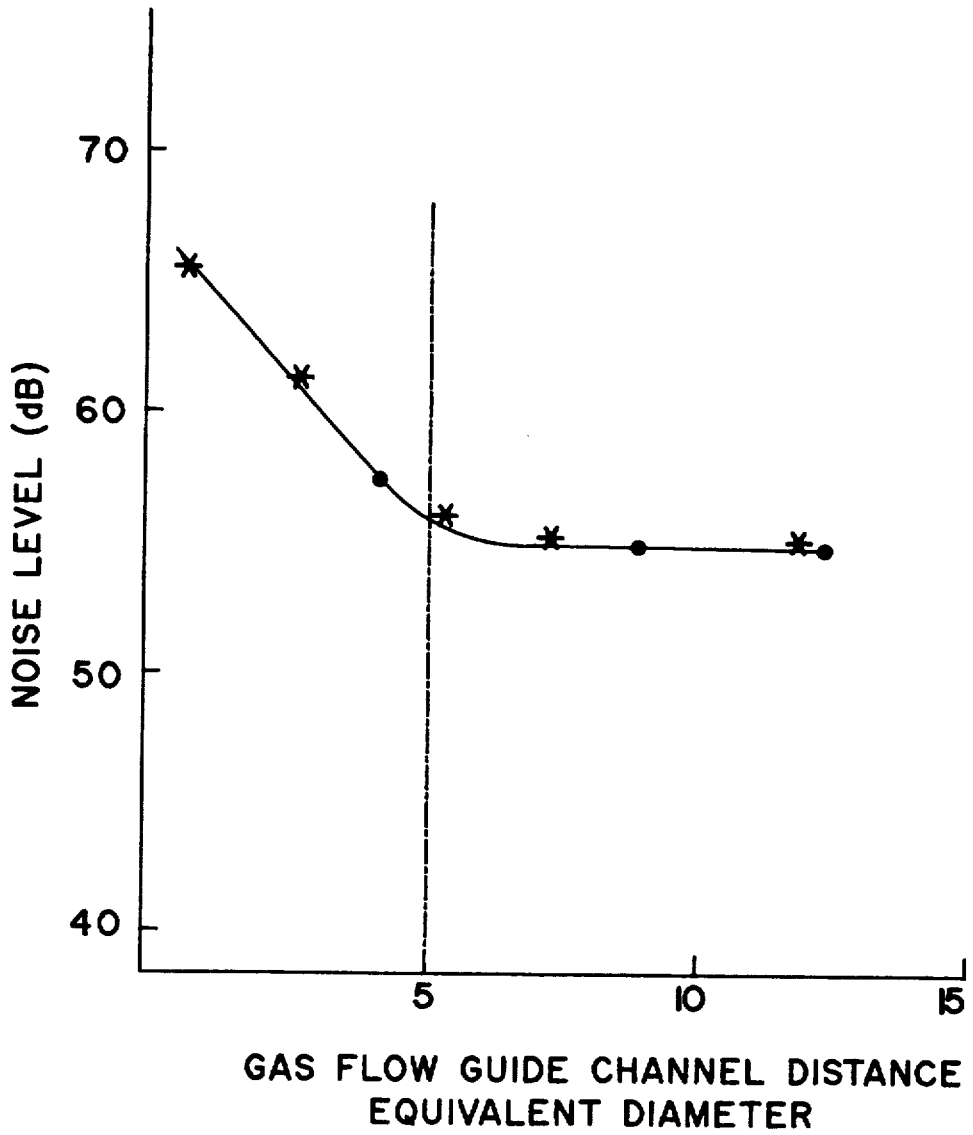
FIG. 13 is a diagram showing measured noise levels during combustion by the burners in conformity with the present invention.

FIG. 13 shows a measurement example of noise levels due to the combustion by the burners in conformity with the present invention. The diagram shows the noise levels for various vertical length h of the strips 6a and 6b of the flame port portions 3a and 3b, i.e., various gas flow guide channel distances of burners in conformity with the embodiment described above. The ratio of the gas flow guide channel distance to the equivalent diameter of the flame ports is chosen as the abscissa, and the noise level is chose as the ordinate. In the diagram, closed circles show measurements. The diagram also shows the measurements with burners of another example described later, i.e., burners with the gas flow guide channels formed by thick plates 22 with flame ports formed through them. The measurements are indicated by *.

From the diagram, it can be seen that the noise level generated by combustion can be gradually lowered by elongating the gas flow guide channel distance, and that when the distance is not less than 5 times the equivalent diameter, the noise level can be practically and sufficiently lowered.

In this embodiment, the gas flow guide channels by the strips 6a and 6b are provided for both the flame port portions 3a and 3b of the first and second burner units 1a and 1b. However, the gas flow guide channels can be provided for the flame port portions 3a of the first burner units 1a only. In the burner of the present invention, the quantity of the air-fuel mixture spouted from the first burner units 1a is larger than that from the second burner units 1b, and in addition, the first burner units 1a which burn as an air rich mixture are liable to generate noise. So, the noise reduction effect of the gas guide channels is relatively larger in the first burner units. Therefore, even if the gas flow guide channels are provided for the flame port portions 3a of the first burner units 1a only, the burner as a whole can achieve practically sufficient noise reduction effect.

Figure 14:
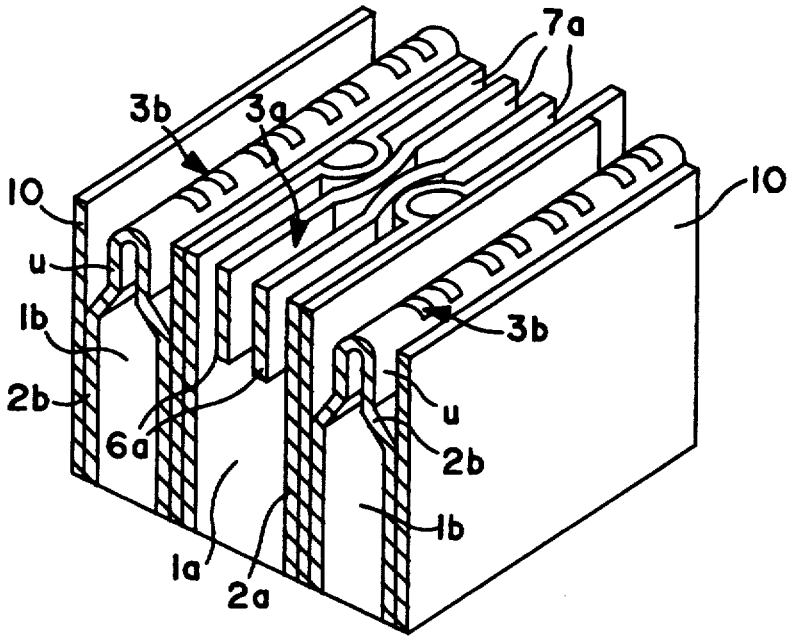
FIG. 14 is a perspective view showing a portion of another embodiment.
Figure 15:
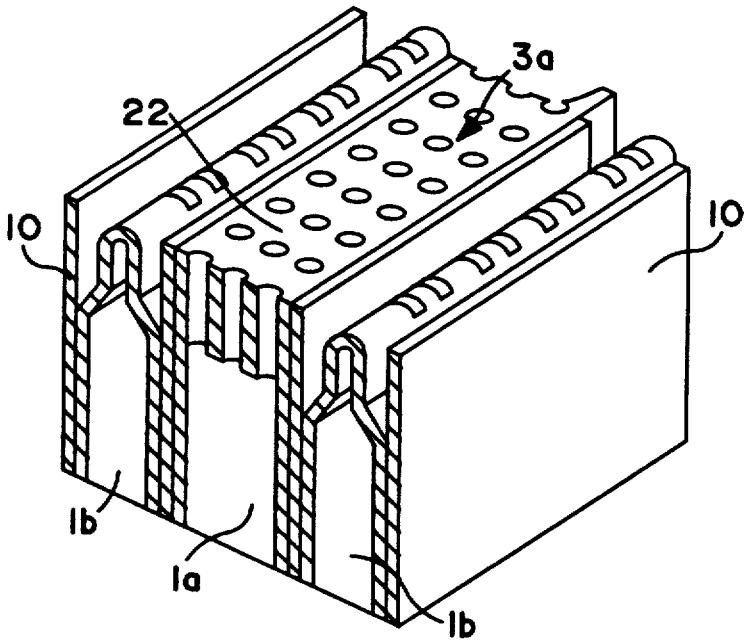
FIG. 15 is a perspective view showing a portion as a further embodiment.
Figure 16:
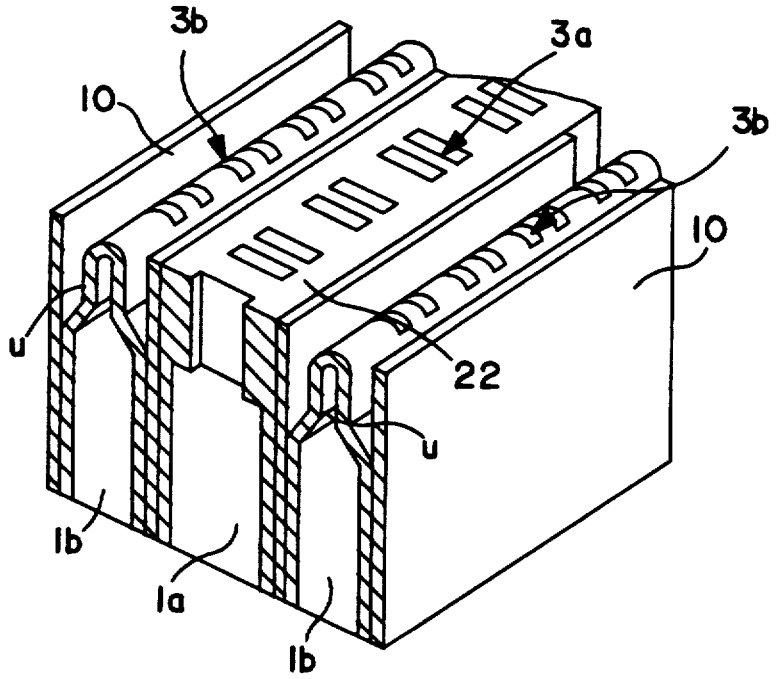
FIG. 16 is a perspective view showing a portion as a still further embodiment.

FIGS. 14, 15 and 16 show other embodiments of the burner of the present invention. They are partial perspective views showing burners with gas flow guide channels provided in the first burner units 1a only.

In the burner of FIG. 14, the flame port portions 3a of the first burner units 1a have the gas guide channels formed by partitioning the flat channels in the upper portions of the burner bodies 2a by the strips 6a as gas flow guide plates, as in the above mentioned example, but in the second burner units 1b, the burner bodies 2b are closed at the flat upper sections u, while slit-like flame ports are formed at the tops of the upper sections u, to constitute flame port portions 3b. Therefore, the flame port portions 3b do not have any special gas flow guide channels. FIGS. 15 and 16 show other examples. In the burners, the flame port portions 3b of the second burner units 1b are formed as in the example of FIG. 14, but in the flame port portions 3a of the first burner units 1a, metallic or ceramic thick plates 22 mounted at the tops of the burner bodies 2a have circular or slit-like flame ports formed to form gas flow guide channels. The gas flow guide channels formed by thick plates 22 with flame ports formed through them can also be provided for the second burner units 1b, though not illustrated. Such gas flow guide channels can also give the noise reduction effect during combustion, as shown in the measurements of FIG. 13.

In the drawings referred to above, symbol 23 denotes an electrode for ignition, and 21, an electrode for flame detection.

The present invention constructed as described above has the following effects:

1. Since the first burner units for burning a lean fuel mixture and the second burner units for burning a rich fuel mixture can be mounted alteratively at a high density, a burner, small in size but large in quantity of combustion, can be obtained.

2. Since the quantity of fuel gas used in the combustion of air rich mixture is relatively larger, the quantity of $NO_x$ generated is smaller for the quantity of combustion by the burner as a whole.

3. Since the combustion of the air rich mixture can be effected to be stable without causing lift of flames and oscillating combustion, the generation of noise can be inhibited.

4. The gas flow guide channels formed at the flame port portions can further inhibit the generation of noise.

5. The distance from the inlet to the flame port portion in each of the first burner units is longer than that in each of the second burner units, and so the mixing of the fuel gas and air is achieved well in the first burner units. Therefore, in the first burner units, a large quantity of air-fuel mixture with lean fuel uniformly mixed can be supplied to the flame port portions.

6. The lean fuel mixture is obtained by mixing fuel gas and air at each burner unit. So, even if a back fire occurs due to insufficient mixing caused by clogging, etc., it is localized, and large noise and damage can be prevented.

7. When we use metallic strips as gas flow guide a cost increase does not occur, because metal is cheap compared to ceramic material.

What is claimed is:

1. A low NOx gas burner for a small combustion apparatus comprising:

a) a plurality of first and second burner units arranged alternatively and adjacently with each other, wherein each of said burner units is an enclosed unit having a separate fuel supply and includes a flat and vertical burner body having a top and bottom section; a flame port portion located at said top section; an inlet located at said bottom section; and a mixing channel extending from said inlet to said flame port portion; and b) a plurality of fuel gas spouts means for supplying fuel to said burner units are positioned such that a fuel gas spout means is located at each inlet of each first and second burner unit and wherein said inlets and said fuel gas spouts means for said first burner units are located below and adjacent to said inlets and said fuel gas spouts means of said second burner units;

c) wherein a lean fuel mixture is supplied to said first burner units and a rich fuel mixture is supplied to said second burner units;

d) wherein said first burner units are longer than said second burner units and a larger quantity of fuel is supplied to said first burner unit; and e) wherein said first burner units are bracketed by said second burner units.

2. A low NOx gas burner according to claim 1 wherein said burner body of said first burner units has a thin top section and a thick bottom section and said second burner units are positioned alternatively and adjacently between said top sections of said first burner units.

3. A low NOx gas burner according to claim 1 wherein said first burner units are further comprised of gas flow guide channels having a vertical length not less than 5 times the equivalent diameter of said flame port portion.

4. A low NOx gas burner according to claim 3 wherein said gas flow guide channels are formed by inserting strips or guide plates in said flame port portion in said top section.

5. A low NOx gas burner according to claim 3 wherein said gas flow guide channels are formed by inserting thick plates having perforated flame ports in said top section.

6. A low NOx gas burner according to claim 1 wherein said second burner units are further comprised of gas flow guide channels having a vertical length not less than 5 times the equivalent diameter of said flame port portion.

7. A low NOx gas burner according to claim 6 wherein said gas flow guide channels are formed by inserting strips or guide plates in said flame port portion in said top section.

8. A low NOx gas burner according to claim 6 wherein said gas flow guide channels are formed by inserting thick plates having perforated flame ports in said top section.

9. A low NOx gas burner according to claim 1 wherein said inlet of said first burner has a larger bore than said inlet of said second burner.

10. A low NOx gas burner according to claim 1 further comprising a throttle portion.

11. A low NOx gas burner according to claim 1 wherein said first burner units are further comprised of a narrowing portion.

12. A low NOx gas burner according to claim 1 wherein said second burner units are further comprised of flame retention plates.

13. A low NOx gas burner according to claim 1 wherein said second burner units are further comprised on an air-fuel mixture ejection hole.

14. A small, low NOx combustion apparatus comprising in operable combination:

a housing;

an air chamber;

an air fan means for supplying air to said air chamber;

a plurality of rich fuel burning units mounted in said housing, and connected to said air chamber, wherein said burner units includes a short, flat and vertical burner body having a top and bottom section; a flame port portion located at said top section; an inlet located at said bottom section; and a mixing channel extending from said inlet to said flame port portion;

a plurality of lean fuel burning units mounted in said housing between said rich fuel burning units, and connected to said air chamber, wherein said burner units includes a long, flat and vertical burner body having a top and bottom section; a flame port portion located at said top section; an inlet located at said bottom section; and a mixing channel extending from said inlet to said flame port portion;

a rich fuel nozzle holder means having a nozzle associated with each of said inlet of said rich fuel burning units at said inlet for forming a spout of air and fuel when fuel leaves said nozzle and encounters air in said air chamber;

a lean fuel nozzle holder means having a nozzle associated with each of said inlet of said lean fuel burning units for forming a spout of air and fuel when fuel leaves said nozzle and encounters said air in said air chamber;

wherein said inlets and said nozzles associated with lean burner units are located below and adjacent to said inlets and said nozzles associated with said rich burner units; and wherein said rich and lean fuel burning units are alternatively and adjacently located in said housing thereby providing areas of rich fuel flame on two sides of lean fuel flame.

15. A combustion apparatus according to claim 14 wherein the quantity of fuel supplied to said lean fuel burning units is greater than the quantity of fuel supplied to said rich fuel burning units.

16. A combustion apparatus according to claim 14 further comprising in said rich burner units a gas flame channel guides having a length not less than 5 times the equivalent diameter of said flame port portions.

17. A combustion apparatus according to claim 14 further comprising in said lean burner units gas flame channel guides having a length not less than 5 times the equivalent diameter of said flame port portions.

18. A combustion apparatus according to claim 14 further comprising a partition means for dividing said rich fuel holding means and said lean fuel holding means into portions; communicating means for connection said portions of said holding means; and fuel gas supply means for supplying gas to said portions.

19. A combustion apparatus according to claim 14 further comprising a combustion quantity control means for adjusting said fuel gas supply means in a stepwise manner.

* * * * *